US006538378B1

(12) United States Patent
Nakano

(10) Patent No.: US 6,538,378 B1
(45) Date of Patent: Mar. 25, 2003

(54) LOW-PRESSURE MERCURY VAPOR DISCHARGE LAMP AND ULTRAVIOLET-RAY IRRADIATING APPARATUS AND METHOD USING THE SAME

(75) Inventor: Koji Nakano, Hachioji (JP)

(73) Assignee: Photoscience Japan Corporation, Tokyo (JP)

( * ) Notice: Subject to any disclaimer, the term of this patent is extended or adjusted under 35 U.S.C. 154(b) by 26 days.

(21) Appl. No.: 09/589,786

(22) Filed: Jun. 8, 2000

(30) Foreign Application Priority Data

Jun. 11, 1999 (JP) ..... 11-165656

(51) Int. Cl.[7] ..... H01J 17/20; H01J 17/16

(52) U.S. Cl. ..... 313/571; 313/635; 313/639

(58) Field of Search ..... 313/571, 557, 313/553, 490, 110, 112, 637, 638, 639, 640, 635, 565, 566

(56) References Cited

U.S. PATENT DOCUMENTS 3,007,071 A * 10/1961 Lompe et al. ..... 313/493
4,017,735 A * 4/1977 Siegel ..... 250/430
5,753,999 A 5/1998 Roozekrans et al.
5,801,482 A 9/1998 Verhaar et al.

FOREIGN PATENT DOCUMENTS

EP 00 11 2254 10/2000

OTHER PUBLICATIONS

Electro–Optical Handbook Technical Series EOH–11, Aug. 1974, copyright by RCA Corporation, p. 76.*

* cited by examiner

*Primary Examiner*—Vip Patel
*Assistant Examiner*—Joseph Williams
(74) *Attorney, Agent, or Firm*—Morrison & Foerster LLP

(57) ABSTRACT

In a low-pressure mercury vapor discharge lamp which has an effective light emission length not shorter than 40 cm and a lamp input density not lower than 0.9 W/cm and which contains at least mercury as a light-emitting metal and an activating rare gas, the mercury is provided in an amalgam with another metal, and a thin coating functioning to trap a very minute amount of the mercury is formed on a glass inner surface of the discharge lamp. The thin coating contains, as its main ingredient, an oxide of at least one metal selected from a group of aluminum, silicon, calcium, magnesium, yttrium, zirconium and hafnium. The amalgam is secured to one or more locations of the glass inner surface facing a discharge space of the discharge lamp. Thus, it is possible to lower a necessary discharge-starting voltage and accelerate a rise time of a light amount of ultraviolet rays.

8 Claims, 3 Drawing Sheets

LOW-PRESSURE MERCURY VAPOR DISCHARGE LAMP AND ULTRAVIOLET-RAY IRRADIATING APPARATUS AND METHOD USING THE SAME

TITLE OF THE INVENTION

Low-pressure Mercury Vapor Discharge Lamp and Ultraviolet-ray Irradiating Apparatus and Method Using the Same

BACKGROUND OF THE INVENTION

The present invention relates to a low-pressure mercury vapor discharge lamp with a relatively high electric power density and a relatively long effective light emission length which is suitable for use in purification, sterilization, disinfection or the like of water by radiation of ultraviolet rays, as well as an ultraviolet-ray irradiating apparatus and method using such a low-pressure mercury vapor discharge lamp.

Ultraviolet rays of a short wavelength range have been used for sterilization, decomposition of toxic organic substances, etc., and low-pressure mercury vapor discharge lamps have heretofore been known as sources for generating ultraviolet rays having a wavelength, for example, of 185 nm or 254 nm. Generally, the low-pressure mercury vapor discharge lamps contain a rare gas, such as argon (Ar) along with a superfluous amount of mercury, and a vapor pressure (vaporization amount) of the mercury varies in response to a temperature of a coldest portion within the discharge lamp. Radiation efficiency of the ultraviolet rays is closely related with the mercury vapor pressure; for example, the 254 nm ultraviolet rays present a highest radiation efficiency at a vapor pressure of about $6\times10^{-3}$ torr and at a 40° C. temperature. At 70° C., the vapor pressure of the ultraviolet rays rises to about $5\times10^{-2}$ torr, and the radiation efficiency decreases by more than 20%. For this reason, the low-pressure mercury vapor discharge lamp is normally designed such that the temperature during operation is held at and around 40° C. In recent years, attempts have been made to increase the density of electrical energy input to the discharge lamp (lamp input density) for an enhanced processing capability of the discharge lamp; in this case, the operating temperature would exceed 40° C., so that there has been employed an approach of enclosing the mercury in an amalgam state. This approach comprises alloying the mercury with another metal, such as bismuth (Bi), tin (Sn) or indium (In) and placing the resultant alloy within the discharge lamp to thereby suppress the mercury vapor pressure during high-temperature operation. Exemplary comparison between a vapor pressure curve of an indium-bismuth amalgam and a vapor pressure curve of mercury (pure mercury) is given in FIG. 5.

FIG. 4 shows an example of a conventional low-pressure mercury vapor discharge lamp. Here, reference numeral 1 represents a light-emitting tube bulb formed of quartz glass, which has opposite ends hermetically closed by glass stems 2*a* and 2*b*. Reference numeral 4 represents an indium-bismuth amalgam fixed on the glass stem 2*a*. Reference numerals 21*a* and 21*b* represent a pair of filaments, which are each coated with a barium-oxide (BaO)-based thermoelectronic substance in order to permit a smooth electric discharge. These filaments 21*a* and 21*b* are retained on the respective glass stems 2*a* and 2*b*, and are electrically connected, via lead wires 22*a*, 22*b* and 22*c*, 22*d*, to terminals 31*a*, 31*b* and 31*c*, 31*d*, respectively, of metallic caps or bases

3*a* and 3*b*. In the light-emitting tube bulb 1, there is also contained an appropriate amount of argon (Ar) gas. Once the low-pressure mercury vapor discharge lamp is turned on by being connected to a predetermined power supply, electric discharge is produced between the filaments 21*a* and 21*b*, so that the mercury vapor is increased by a heat resulting from the electric discharge (discharge heat) and the vaporized mercury atoms are excited to emit ultraviolet rays.

Although the mercury vapor discharge lamp containing an amalgam has a great advantage of ensuring a high ultraviolet-ray radiation efficiency by suppressing the mercury vapor pressure during high-temperature operation, it would present significant inconveniences or disadvantages due to the fact that the mercury vapor pressure is suppressed not only during the high-temperature operation but also in low-temperature conditions prior to the turning-on or lighting-up of the lamp. One of such inconveniences is that the discharge lamp can not be readily activated because a high voltage is required to start the electric discharge. Normally, the temperature within the light-emitting tube bulb prior to the lighting-up is substantially equal to a temperature of an atmosphere in which the lamp is placed. For example, in a situation where the temperature of the atmosphere is 20° C., there exists a mercury vapor pressure of about $1.2\times10^{-3}$ torr in a discharge lamp containing a normal form of mercury (pure mercury), and the necessary discharge-starting voltage can be lowered greatly by the Penning effect produced by the mercury vapor pressure and argon gas, so that the electric discharge can be initiated smoothly. By contrast, in a discharge lamp containing an amalgam, the mercury vapor pressure prior to the lighting-up is suppressed below 1/10 of that in the above-mentioned mercury-containing discharge lamp, which would lessen the Penning effect and hence raise the necessary discharge-starting voltage level. Thus, activating the amalgam-containing discharge lamp would require a higher discharge-starting voltage than required for activation of the traditional-type discharge lamp.

Another inconvenience presented by the amalgam-containing discharge lamp is a slow rise in the light amount of the emitted ultraviolet rays. It is considered that a primary cause of such a slow rise in the light amount is a synergism of several factors, such as: insufficient emission of ultraviolet rays immediately after the lighting-up due to an inherently small amount of mercury vapor within the discharge lamp; an insufficient lamp input immediately after the lighting-up because of the small mercury vapor amount; a hard-to-warm tendency of the discharge lamp due to an insufficient discharge heat resulting from the insufficient lamp input immediately after the lighting-up; and even slower evaporation of the mercury from the amalgam due to the hard-to-warm tendency of the discharge lamp.

Even in the discharge lamp containing the mercury in an amalgam state, these inconveniences would not lead to practical problems as long as the lamp's effective light emission length (which equals a length between the filaments) is relatively short. Because, the discharge lamps with a short effective light emission length can be activated with a relatively low discharge-starting voltage and can be filled with mercury vapor at a rapid speed. Further, in the discharge lamp with a low lamp input density, presence of the above-mentioned inconveniences is not even considered to be problematic, because there is no absolute necessity to contain the mercury in an amalgam state. However, the above-mentioned inconveniences would become serious problems with such an elongated, high-density discharge lamp that is often required in the field of purification processing by ultraviolet rays. Namely, in recent years, there has been an increasing demand for further enhanced processing capabilities in the field of the purification processing based on use of ultraviolet rays, and therefore a discharge lamp with a longer effective light emission length as well as a higher lamp input density has become necessary for an increased processing capacity. In such a discharge lamp with a longer effective light emission length, the above-mentioned inconveniences would become significant problems to be properly overcome since the necessary discharge-starting voltage has to increase as the effective light emission length increases and the increased effective light emission length results in a greater time lag until the mercury vapor fills the entire interior of the discharge lamp. As an example of such a discharge lamp, there is currently being used a high-density discharge lamp with a lamp input density exceeding about 1 W/cm. With this type of high-density discharge lamp, the temperature during the lighting-up operation would become very high so that there arises a need to employ an amalgam with a further suppressed mercury vapor pressure. If such an amalgam with a further suppressed mercury vapor pressure is employed, the necessary discharge-starting voltage has to increase, which would result in a slower rise in the light amount of the ultraviolet rays.

According to the concept of the conventionally-known technique, an even higher voltage is required to start the electric discharge in the above-mentioned type of elongated, high-density discharge lamp. However, the even higher discharge-starting voltage is undesirable, because the sterilization technique and technique of decomposing toxic organic substances using ultraviolet rays are often employed in applications, such as water purification processing, where water is processed with the ultraviolet rays and the excessive discharge-starting voltage could cause a breakdown (electric discharge through an insulator) of related equipment. Further, from a viewpoint of environmental protection, it is absolutely necessary to avoid a spill of raw water having been processed insufficiently due to the slow rise in the light amount of the ultraviolet rays.

SUMMARY OF THE INVENTION

It is therefore an object of the present invention to provide an improved low-pressure mercury vapor discharge lamp with a high lamp input density and long effective light emission length which requires only a low discharge-starting voltage such that it can light up without a very high voltage having to be applied thereto and which permits a rapid rise in a light amount of ultraviolet rays. It is another object of the present invention to provide an ultraviolet-ray irradiating apparatus using such an improved low-pressure mercury vapor discharge lamp.

According to one aspect of the present invention, there is provided a low-pressure mercury vapor discharge lamp which has an effective light emission length not shorter than 40 cm and a lamp input density, per unit length of the effective light emission length, not lower than 0.9 W/cm and which contains at least mercury as a light-emitting metal and an activating rare gas. The low-pressure mercury vapor discharge lamp of the invention is characterized in that the mercury is provided in an amalgam with another metal and that the discharge lamp further includes a thin coating formed on a glass inner surface thereof for trapping a minute amount of the mercury. During lighting-up operation of the low-pressure mercury vapor discharge lamp thus arranged, an appropriate amount of the mercury, corresponding to a temperature of the amalgam, vaporizes, which contributes to a higher efficiency of ultraviolet ray emission. Once the low-pressure mercury vapor discharge lamp is turned off (caused to stop illuminating), part of the mercury vapor returns to the amalgam while the remaining part of the mercury vapor present in the vicinity of the mercury-trapping thin coating is drawn, as grains of mercury, onto the thin coating on the glass inner surface of the discharge lamp. Thus, when the discharge lamp is turned on next, only a low discharge-starting voltage is required because of presence of mercury vapor from the grains of mercury sticking to the thin coating. In addition, the presence of the mercury vapor at the lighting-up of the discharge lamp achieves a quick rise in the light amount of the ultraviolet rays. Consequently, the low-pressure mercury vapor discharge lamp of the present invention can effectively avoid the inconveniences of the conventionally-known technique.

Particularly, with the conventionally-known low-pressure mercury vapor discharge lamp whose effective light emission length is 40 cm or more, the necessary discharge-starting voltage would exceed 1,000 V, and thus even more stringent safety would be required as specified by the technical standards for electric facilities and equipment, with the result that the discharge lamp tends to become more expensive. However, the present invention can eliminate such a problem because it can greatly lower the necessary discharge-starting voltage as compared to the conventional discharge lamp. Thus, the present invention achieves great benefits when the basic principles thereof are applied to a low-pressure mercury vapor discharge lamp whose effective light emission length is not shorter than 40 cm. Further, where the lamp input density is 0.9 W/cm or more, it would become difficult to attain an appropriate coldest temperature within the discharge lamp unless the mercury is contained in an amalgam state, even when the discharge lamp is lit up under low-temperature conditions with an atmosphere temperature of about 10° C. In such a case, the inconveniences as discussed earlier would be encountered. However, the present invention can provide effective solutions to the inconveniences and therefore achieves great benefits when the basic principles thereof are applied to a low-pressure mercury vapor discharge lamp whose input density is not lower than 0.9 W/cm.

In a preferred embodiment of the present invention, the thin coating for trapping a minute amount of the mercury includes, as its main ingredient, an oxide of at least one metal selected from a group consisting of aluminum (Al), silicon (Si), calcium (Ca), magnesium (Mg), yttrium (Y), zirconium (Zr) and hafnium (Hf). The oxide of each of these metals has a good heat resistance and chemical stability and thus can effectively function as the mercury-trapping thin coating.

Further, according to the present invention, the amalgam may be secured to one or more locations of the glass inner surface facing the discharge space of the low-pressure mercury vapor discharge lamp. By the amalgam being thus secured to the glass inner surface facing the discharge space, the amalgam is exposed directly to the discharge space so that the temperature of the amalgam can increase relatively rapidly after the discharge lamp is turned on or lit up, which can promote vaporization of the mercury from the amalgam and thus even further promote the quick rise in the light amount of the ultraviolet rays.

Further, the present invention provides an ultraviolet-ray irradiating apparatus which is characterized by using the above-mentioned inventive low-pressure mercury vapor discharge lamp, as an ultraviolet-ray emitting source, to irradiate ultraviolet rays onto an object to be sterilized or disinfected. Because the inventive low-pressure mercury vapor discharge lamp can be activated with a low discharge-starting voltage and achieves a quick rise in the light amount of the ultraviolet rays and because it is designed as a high-density and elongated discharge lamp (with the lamp input density of 0.9 W/cm or more and the effective light emission length of 40 cm or more), the ultraviolet-ray irradiating apparatus using the inventive low-pressure mercury vapor discharge lamp can work with extremely high performance and reliability.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Figure 1:
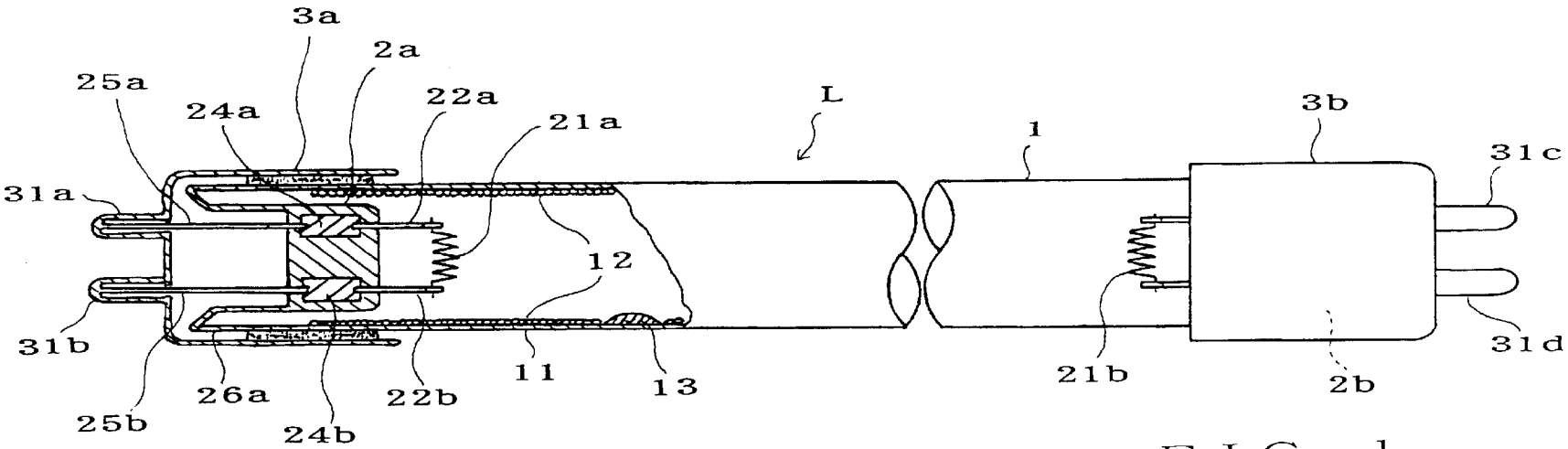
FIG. 1 is a side view, partly in section, of a low-pressure mercury vapor discharge lamp in accordance with a preferred embodiment of the present invention.

FIG. 1 is a side view, partly in section, of a low-pressure mercury vapor discharge lamp L in accordance with a preferred embodiment of the present invention. Although only a left end portion of the discharge lamp L is shown in section to demonstrate an inner structure of the discharge lamp, it should be appreciated that a right end portion of the discharge lamp L has a similar inner structure. The low-pressure mercury vapor discharge lamp L of FIG. 1 includes a light-emitting tube portion 1, glass stem portions 2*a* and 2*b*, and cap or base portions 3*a* and 3*b*. In the illustrated example, the light-emitting tube portion 1 includes a light-emitting tube bulb 11 formed of quartz glass and having an inner diameter of 22 mm and wall thickness of 1 mm, and a thin coating or film 12 functioning to trap a very minute amount of mercury is formed on a glass inner surface of the light-emitting tube bulb 11. The thin coating 12 comprises a substance having a good heat resistance and chemical stability, such as an aluminum oxide, which has fine projections and depressions, wrinkles or folds or fine powders fixed thereto. Within the light-emitting bulb 11, a pair of filaments 21*a* and 21*b* are provided at opposite end portions of the bulb 11 and spaced from each other, for example, by a distance of 150 cm. Each of the filaments 21*a* and 21*b* has a barium-oxide-based emitter fixedly attached thereto. Further, each of the bases 3*a* and 3*b*, which are made of a ceramic material, is provided with a pair of electric terminals 31*a* and 31*b* or 31*c* and 31*d*.

Describing in more detail the structure of the left end portion of the light-emitting tube portion 1, the filament 21*a* is retained by two inner leads 22*a* and 22*b* extending, in a longitudinal direction of the lamp, from the corresponding glass stem 2*a* formed of quartz glass. The quartz glass stem 2*a* functions to electrically connect between the filament 21*a* and the electric terminals 31*a*, 31*b* by way of the inner leads 22*a*, 22*b*, molybdenum films 24*a*, 24*b* and outer leads 25*a*, 25*b* while attaining gastightness via its flare portion 26*a* and the molybdenum films 24*a* and 24*b*. Reference numeral 13 represents an amalgam that is secured to the inner surface of the light-emitting tube bulb 11 at a location spaced inwardly (toward the center of a discharge space) from the filament 21*a* by about 15 cm. The right end portion of the light-emitting tube portion 1 is constructed in a similar manner to the above-described left end portion. Although not specifically shown, a further amalgam 13 may be secured to the inner surface of the light-emitting bulb 11 at a location spaced inwardly from the other filament 21*b* by about 15 cm. Namely, the amalgam 13 may be provided at one or more locations of the glass inner surface of the light-emitting tube bulb 11 facing the discharge space.

Figure 4:
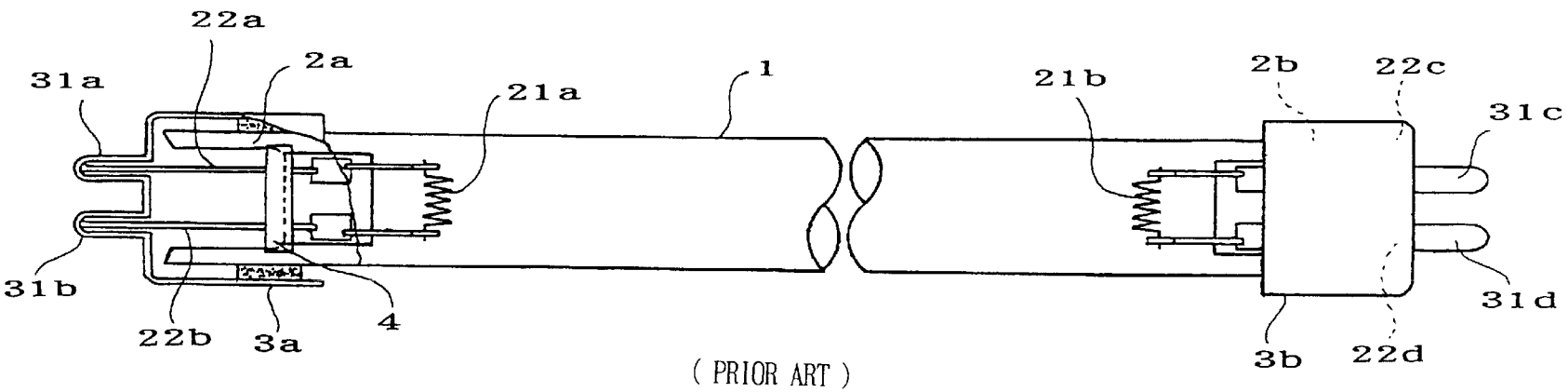
FIG. 4 (PRIOR ART)
FIG. 4 is a side view, partly in section, of a conventionally-known low-pressure mercury vapor discharge lamp.

In the light-emitting tube bulb 11, an activating rare gas, such as an argon gas of one torr, is contained in a gastight manner. The amalgam 13 preferably comprises an indium amalgam whose mercury vapor pressure is suppressed further than the amalgam shown in FIG. 4, so that a sufficiently high ultraviolet-ray radiation efficiency can be maintained even at high temperatures in the range of 90° C.–100° C. Further, the thin aluminum-oxide coating 12, functioning to trap a very minute amount of the mercury, is previously formed on the bulb's glass inner surface before the filaments and glass stems are enclosed in the bulb 11. The thin aluminum-oxide coating 12 can be formed easily, for example, by first applying, to the bulb's glass inner surface, a suspension comprising fine aluminum-oxide powders and a binding agent suspended in butyl acetate. The thin coating 12 employed in the embodiment is very advantageous in that it can greatly increase the total area of the inner surface of the light-emitting bulb 11, by virtue of the fine powders and a greater amount of the mercury can be readily introduced between the fine powders.

The following paragraphs describe results of experiments performed on the present invention. When the low-pressure mercury vapor discharge lamp L of the present invention, arranged in the above-described manner, was connected to a predetermined power supply to be energized with an electric input of 300 W, the discharge lamp L could be lit up at a low voltage and also accomplished a rapid rise in the ultraviolet ray output owing to the mercury vapor trapped on the thin aluminum-oxide coating 12; more than 30% of the input was radiated as 254 mn ultraviolet rays. Further, when an ultraviolet-ray irradiating apparatus, comprising a dozen of the inventive low-pressure mercury vapor discharge lamps arranged in the above-mentioned manner, was used to perform sterilization processing on running water, an extremely great amount, as much as 5,000 tons per day, of the water could be appropriately processed continuously. Furthermore, prior to these experiments, the low-pressure mercury vapor discharge lamp L according to the described embodiment of the present invention was evaluated, in comparison with the conventional counterpart, for the discharge-starting voltage and ultraviolet-ray rise characteristics, from which it was ascertained that the inventive discharge lamp L could significantly improve the two characteristics as compared to the conventional discharge lamp.

Figure 2:
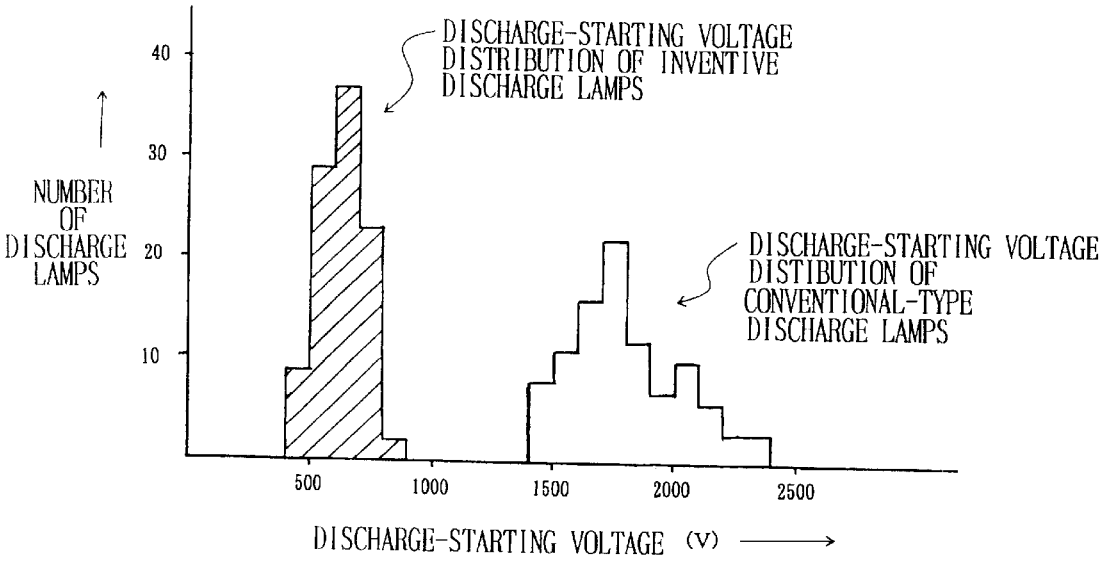
FIG. 2 is a histogram showing a discharge-starting voltage distribution measured for the low-pressure mercury vapor discharge lamp according to the preferred embodiment in contradistinction with a discharge-starting voltage distribution measured for a conventionally-known low-pressure mercury vapor discharge lamp.
Figure 3:
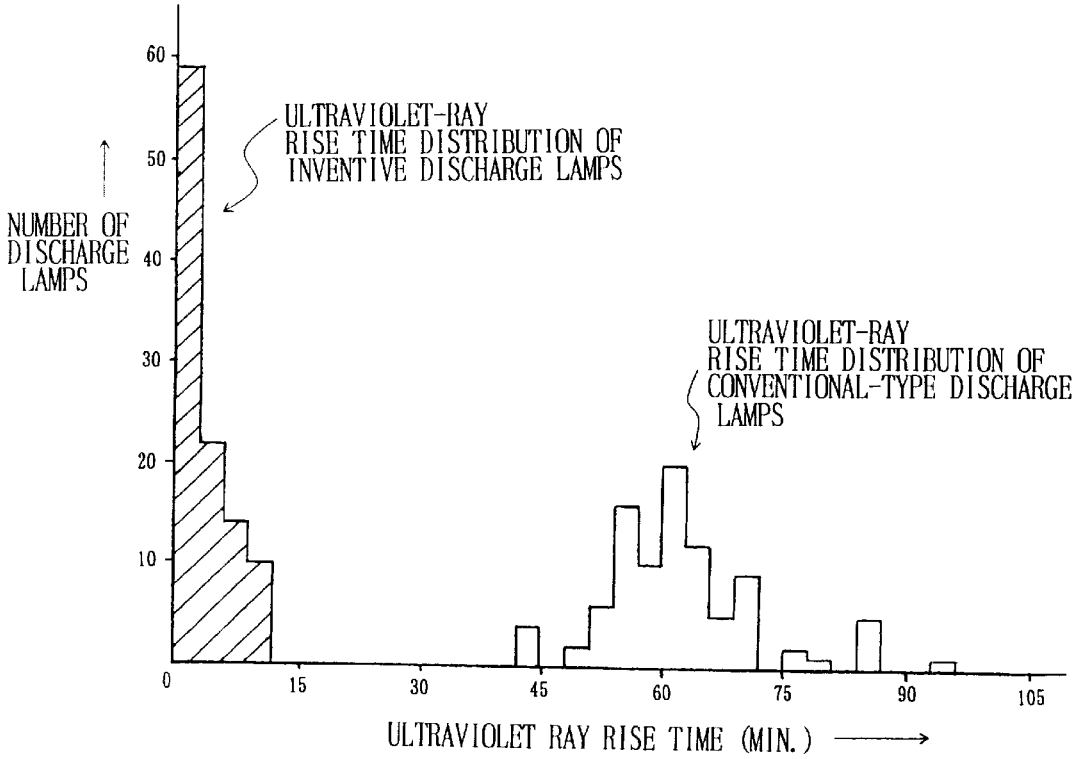
FIG. 3 is a histogram showing an ultraviolet-ray rise time distribution measured for the low-pressure mercury vapor discharge lamp according to the preferred embodiment in contradistinction with an ultraviolet-ray rise time distribution measured for the conventionally-known low-pressure mercury vapor discharge lamp.
Figure 5:
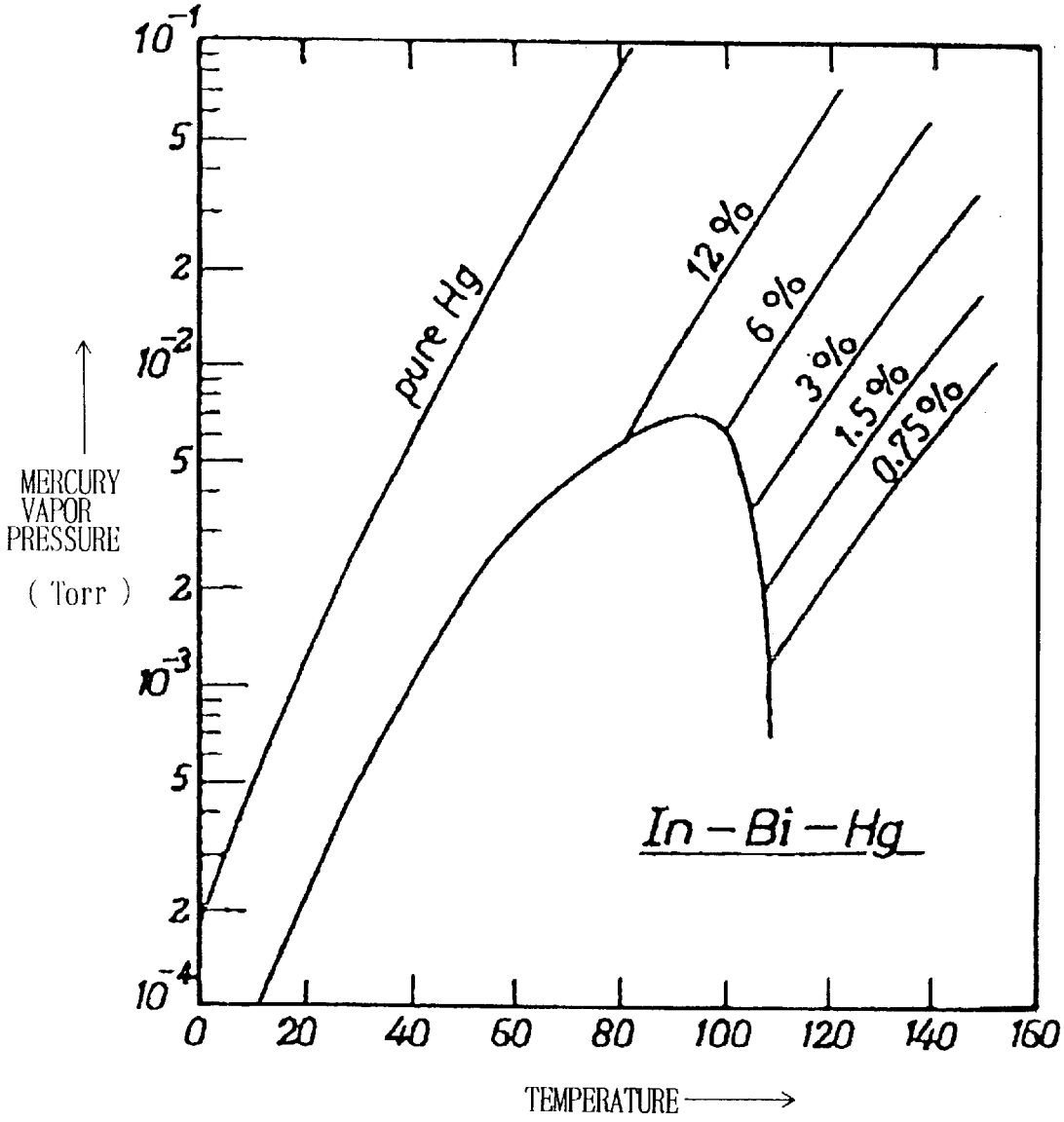
FIG. 5 is a graph showing a vapor pressure curve of an indium-bismuth amalgam in contradistinction with a vapor pressure curve of mercury (pure mercury).

In addition, 100 low-pressure mercury vapor discharge lamps according to the described embodiment of the present invention ("inventive discharge lamps") and 100 conventional-type low-pressure mercury vapor discharge lamps (which are similar in structure to the inventive discharge lamps except that they include no mercury-trapping thin coating) were fabricated on an experimental basis and evaluated for the discharge-starting voltage and ultraviolet-ray rise characteristics. Results of the evaluations are shown in FIGS. 2 and 3. More specifically, FIG. 2 is a histogram, calibrated in 100 volts, of discharge-starting voltages evaluated within a constant temperature bath of 20° C., from which it is clear that the inventive discharge lamp L could significantly lower the necessary discharge-starting voltage as compared to the conventional counterpart.

FIG. 3 is a histogram, calibrated in five minutes, of ultraviolet-ray rise times, which were evaluated by inserting each of the inventive and conventional-type discharge lamps in a water-cooled outer tube of quartz glass fixed to a steel flange, just as in an actual application, and then lighting up the discharge lamps. Quartz glass window was provided substantially at the center of the steel flange, through which the ultraviolet ray output was measured by a 254 nm meter so as to evaluate a time required for the ultraviolet ray output to reach 90% of a predetermined output level attainable during stable illumination of the lamps. As apparent from the histogram of FIG. 3, the inventive discharge lamp L could greatly shorten the rise time and effectively reduce variations in the rise time as compared to the conventional counterpart.

Now, a description will be made about a modification of the above-described embodiment of the present invention. Although the preferred embodiment has been described in relation to the case where the mercury-trapping thin coating 12 includes fine powders of an aluminum oxide, the thin coating 12 may comprise an oxide of another metal, such as silicon (Si), calcium (Ca), magnesium (Mg), yttrium (Y), zirconium (Zr) and hafnium (Hf). Namely, as long as the thin coating 12 comprises, as its main ingredient, an oxide of at least one metal selected from a group consisting of aluminum, silicon, calcium, magnesium, yttrium, zirconium and hafnium, the coating 12 can afford the same advantageous effect as set forth above (i.e., mercury-trapping effect); thus, the oxide of any of the above-mentioned metals can be advantageously used. The thin coating 12 may be formed on either the whole or part of the glass inner surface of the light-emitting tube bulb 11. Further, the amalgam 13 may be provided at one or more desired locations of the bulb's glass inner surface facing the discharge space; in any case, the amalgam 13 may be secured either directly to the bulb's glass inner surface or to the thin coating 12 formed on the glass inner surface. Furthermore, whereas the preferred embodiment has been described above as having the effective light emission length of 150 cm, various modifications of the discharge lamp, of which the effective light emission length is not shorter than 40 cm and the lamp input density per unit length of the effective light emission length is not lower than 0.9 W/cm, are also considered to be within the score of the present invention.

Moreover, the present invention can also be applied to the so-called "electrodeless discharge lamp" having no filament.

The basic principles of the present invention can also be applied to any other discharge lamp containing a mixed neon-argon (Ne—Ar) gas in a gastight manner. Namely, if it is only desired to lower the necessary discharge-starting voltage, filling the lamp with the mixed neon-argon gas will achieve the Penning effect while more or less sacrificing a life characteristic of the lamp, but the filling of the mixed neon-argon gas will not be useful for improving the ultraviolet ray rise characteristic. Therefore, if the basic principles of the present invention are applied to such a discharge lamp containing the mixed neon-argon gas, i.e. if the mercury is provided in an amalgam state and the thin coating for trapping a very minute amount of the mercury is formed on the glass inner surface of the light-emitting tube bulb, the ultraviolet ray rise characteristic can be improved effectively; thus, such a low-pressure mercury vapor discharge lamp containing the mixed neon-argon gas also falls within the scope of the present invention.

In summary, the low-pressure mercury vapor discharge lamp of the present invention is characterized in that the mercury is provided in an amalgam with another metal and that a thin coating is formed on the glass inner surface of the lamp for trapping a minute amount of the mercury. During lighting-up operation of the low-pressure mercury vapor discharge lamp thus arranged, an appropriate amount of the mercury, corresponding to a temperature of the amalgam, vaporizes, which contributes to a higher efficiency of ultraviolet ray emission. Once the low-pressure mercury vapor discharge lamp is turned off, part of the mercury vapor returns to the amalgam while the remaining part of the mercury vapor present in the vicinity of the mercury-trapping thin coating is drawn, as grains of mercury, onto the thin coating on the glass inner surface of the discharge lamp. Thus, when the discharge lamp is turned on next, only a low discharge-starting voltage suffices because of presence of mercury vapor from the grains of mercury adhering to the thin coating. In addition, the presence of the mercury vapor at the initiation of the lamp illumination achieves a quick rise in the light amount of the ultraviolet rays.

Further, where the basic principles of the present invention are applied to a discharge lamp with an effective light emission length of 40 cm or more, the present invention achieves a substantial cost reduction because it can lower the necessary discharge-starting voltage. Particularly, where the basic principles of the present invention are applied to a discharge lamp with a lamp input density of 0.9 W/cm or more, the discharge lamp can be activated with a lower discharge-starting voltage and can accelerate a rise in the ultraviolet rays while advantageously eliminating the inconveniences having heretofore been unavoidably encountered by the conventionally-known discharge lamps containing the mercury in an amalgam state.

Furthermore, using the above-mentioned inventive low-pressure mercury vapor discharge lamp, the present invention can provide an ultraviolet-ray irradiating apparatus which can work with extremely high performance and reliability, because the low-pressure mercury vapor discharge lamp can be activated with a lower discharge-starting voltage and achieves a quicker rise in the light amount of the ultraviolet rays and because the discharge lamp is designed as a high-density and elongated discharge lamp (with the lamp input density of 0.9 W/cm or more and the effective light emission length of 40 cm or more).

What is claimed is:

1. A low-pressure mercury vapor discharge lamp which has an effective light emission length not shorter than 40 cm and a lamp input density, per unit length of the effective light emission length, not lower than 0.9 W/cm and which contains at least mercury as a light-emitting metal and an activating rare gas, characterized in that the mercury is provided in an amalgam with another metal and that said low-pressure mercury vapor discharge lamp further includes a thin coating formed on a glass inner surface thereof for trapping a minute amount of the mercury, the thin coating being in the form of fine projections and depressions, wrinkles or folds formed on the glass inner surface, or fine powders fixed to the glass inner surface.

2. A low-pressure mercury vapor discharge lamp as claimed in claim 1 wherein said thin coating for trapping a minute amount of the mercury includes, as a main ingredient thereof, an oxide of at least one metal selected from a group consisting of aluminum, silicon, calcium, magnesium, yttrium, zirconium and hafnium.

3. A low-pressure mercury vapor discharge lamp as claimed in claim 1 wherein the amalgam is secured to one or more locations of said glass inner surface facing a discharge space of said low-pressure mercury vapor discharge lamp.

4. An ultraviolet-ray irradiating apparatus using a low-pressure mercury vapor discharge lamp, as an ultraviolet-ray emitting source, to irradiate ultraviolet rays onto an object to be sterilized or disinfected, said low-pressure mercury vapor discharge lamp having an effective light emission length not shorter than 40 cm and a lamp input density not lower than 0.9 W/cm and containing at least mercury as a light-emitting metal and an activating rare gas, the mercury being provided in an amalgam with another metal, said low-pressure mercury vapor discharge lamp further including a thin coating formed on a glass inner surface thereof for trapping a minute amount of the mercury, the thin coating being in the form of fine projections and depressions, wrinkles or folds formed on the glass inner surface, or fine powders fixed to the glass inner surface.

5. A method of sterilizing or disinfecting an object, said method using a low-pressure mercury vapor discharge lamp, as an ultraviolet-ray emitting source, to irradiate ultraviolet rays onto the object for sterilization or disinfection thereof, said low-pressure mercury vapor discharge lamp having an effective light emission length not shorter than 40 cm and a lamp input density not lower than 0.9 W/cm and containing at least mercury as a light-emitting metal and an activating rare gas, the mercury being provided in an amalgam with another metal, said low-pressure mercury vapor discharge lamp further including a thin coating formed on a glass inner surface thereof for trapping a minute amount of the mercury, the thin coating being in the form of fine projections and depressions, wrinkles or folds formed on the glass inner surface, or fine powers fixed to the glass inner surface.

6. A low-pressure mercury vapor discharge lamp as claimed in claim 1 wherein said discharge lamp is used to process liquid by irradiating ultraviolet rays to the liquid.

7. An ultraviolet-ray irradiating apparatus as claimed in claim 4 wherein said apparatus processes liquid by ultraviolet rays to the liquid.

8. A method as claimed in claim 5 wherein said method processes liquid by irradiating ultraviolet rays to the liquid.

* * * * *